US007330813B2

(12) United States Patent
Saito

(10) Patent No.: US 7,330,813 B2
(45) Date of Patent: Feb. 12, 2008

(54) SPEECH PROCESSING APPARATUS AND MOBILE COMMUNICATION TERMINAL

(75) Inventor: Mutsumi Saito, Fukuoka (JP)

(73) Assignee: Fujitsu limited, Kawasaki (JP)

( * ) Notice: Subject to any disclaimer, the term of this patent is extended or adjusted under 35 U.S.C. 154(b) by 799 days.

(21) Appl. No.: 10/634,393

(22) Filed: Aug. 5, 2003

(65) Prior Publication Data

US 2004/0042622 A1 Mar. 4, 2004

(30) Foreign Application Priority Data

Aug. 29, 2002 (JP) ..... 2002-250362

(51) Int. Cl.
*G10L 19/06* (2006.01)
*G10L 19/00* (2006.01)
*G10L 13/00* (2006.01)

(52) U.S. Cl. ..... 704/209; 704/219; 704/261; 704/262

(58) Field of Classification Search ..... 704/213, 704/238, 268, 229, 219, 1, 6, 8, 9, 2, 4, 260, 704/205, 203, 228, 256, 272, 222, 209
See application file for complete search history.

(56) References Cited

U.S. PATENT DOCUMENTS 5,822,732 A 10/1998 Tasaki
6,032,116 A * 2/2000 Asghar et al. ..... 704/238
6,098,036 A * 8/2000 Zinser, Jr. et al. ..... 704/219
2002/0046021 A1* 4/2002 Cox et al. ..... 704/229

FOREIGN PATENT DOCUMENTS

JP 2-82710 3/1990
JP 8-305397 11/1996
JP 2000-242298 9/2000

OTHER PUBLICATIONS

Acoustic Society of Japan. Speech Communication Technology. Communication Engineering of Sound. 1st Edition Aug. 30, 1996 p.27 (full translation of p. 27, included).

* cited by examiner

*Primary Examiner*—David Hudspeth
*Assistant Examiner*—Josiah Hernandez
(74) *Attorney, Agent, or Firm*—Katten Muchin Rosenman LLP

(57) ABSTRACT

A speech processing apparatus able to enhance formants more naturally, wherein a speech analyzing unit analyzes an input speech signal to find LPCs and converts the LPCs to LSPs, a speech decoding unit calculates a distance between adjacent orders of the LSPs by an LSP analytical processing unit and calculates LSP adjusting amounts of larger values for LSPs of adjacent orders closer in distance by an LSP adjusting amount calculating unit, an LSP adjusting unit adjusts the LSPs based on the LSP adjusting amounts such that the LSPs of adjacent orders closer in distance become closer, an LSP-LPC converting unit converts the adjusted LSPs to LPCs, and an LPC combining unit uses the LPCs and sound source parameters to obtain formant-enhanced speech.

8 Claims, 9 Drawing Sheets

SPEECH PROCESSING APPARATUS AND MOBILE COMMUNICATION TERMINAL

BACKGROUND OF THE INVENTION

1. Field of the Invention

The present invention relates to a speech processing apparatus in a speech coding apparatus, speech decoding apparatus, speech reproducing apparatus, or the like for improving the intelligibility of a speech signal degraded in quality or enhancing input speech so as to enable output speech to be intelligibly heard even in a noisy environment or other environment where the speech is difficult to understand and a mobile phone or other mobile communication terminal provided with such a speech processing apparatus.

2. Description of the Related Art

Various technologies exists for processing speech signals to improve the intelligibility of speech degraded in quality and difficult to understand. For example, numerous systems have been proposed and applied to mobile phones for so-called "noise cancelers" for removing noise mixed in with speech.

Mobile phones etc. are often used in noisy environments. When using mobile phones in noisy environments, there is the problem that the other party is difficult to understand. Therefore, various technologies have been proposed to enable speech to be easily understood by processing for enhancing the characteristics of the speech.

For example, as a technique for enhancing the formants, important for vowel recognition of speech, Japanese Unexamined Patent Publication (Kokai) No. 2-82710 has proposed technology using a post-processing filter having a transfer characteristic H(z) expressed by the following equation (1):

$$H(z)=\{\Sigma_{i=1}^{n} a[i](\beta z)^{-1}\}/\{\Sigma_{i=1}^{m} a[i](\alpha z)^{-1}\} \quad (1)$$

In the above equation (1), "a[i]" is a linear prediction coefficient (LPC), while $\alpha$ and $\beta$ are suitably determined constants. By using a post-processing filter having a characteristic expressed by the above equation (1), the formant frequency component is enhanced and the subjective quality of the encoded speech is improved.

Further, various technologies have been proposed for formant enhancement using line spectrum pairs (LSPs). An LSP is a frequency parameter expressing the characteristics of speech. If expressing an LSP by the variable $\omega$, $\omega$ is usually in the range of $0 \leqq \omega \leqq \pi$, but depending on the method of expression, it is sometimes also expressed by a range normalized to a value between 0 and 1, that is, $0 \leqq \omega \leqq 1$. Alternatively, it is sometimes expressed as $0 \leqq \omega \leqq 4000$ (Hz). Further, the cosine of an LSP, that is, $\cos(\omega)$, is also called an "LSP". An LSP can be calculated by computation from an LPC. Further, an LPC can be calculated from an LSP.

By setting as the LSPs values increasing steadily from a low order to a high order, it is known that the later filtering proceeds stably. Further, the smaller the distance (difference) between LSP values of adjacent orders, the stronger the peak that appears in the formants of the speech. This property becomes greater the closer the value of an LSP to 0. LSPs are for example explained in detail in for example the Acoustic Society of Japan, "*Oto no Komunikeesyon Kogaku*" (*Communication Engineering of Sound*), first edition, Corona, Aug. 30, 1996, p. 27.

Japanese Unexamined Patent Publication (Kokai) No. 8-305397 proposes a speech processing filter calculating an interior division value with predetermined LSP values (values arranged at equal intervals on the frequency) for input values of LSPs, making corrections to widen portions where the distance between adjacent orders is less than a predetermined value, and increasing the freedom of characteristics of the speech processing filter and obtaining an excellent formant enhancement effect without causing distortion of the level of perception in the range of the permissible spectral gradients.

Japanese Unexamined Patent Publication (Kokai) No. 2000-242298 proposes an LSP correction device which uses an ascending order LSP corrector which calculates the distance between adjacent orders successively from the lower order of the LSPs and widens the distance between orders when the distance between orders falls below a threshold and a descending order LSP corrector which calculates the distance between adjacent orders successively from the higher order of the LSPs and widens the distance between orders when the distance between orders falls below a threshold so as to enable the distance between orders to be sufficiently widened with a good balance.

The above related art, however, suffered from the following problems.

In the post-processing filter of Japanese Unexamined Patent Publication (Kokai) No. 2-82710, it was necessary to adjust the constant parameters $\alpha$ and $\beta$. These parameters, however, are difficult to adjust since it is difficult to determine the correspondence between frequency characteristics and auditory effects. If unsuitably adjusted, the sound quality conversely ends up deteriorating.

Further, in the speech processing filter of Japanese Unexamined Patent Publication (Kokai) No. 8-305397, since the correction is made by obtaining the interior division point between the LSP values of the speech signal and LSP values arranged at equal intervals in advance, when the original LSP values concentrate at a lower band, the speech ends up shifting to a high frequency overall and the output speech is liable to sound strange.

Further, in the LSP correction device of Japanese Unexamined Patent Publication (Kokai) No. 2000-242298, since the LSP values of adjacent orders are successively changed, when there is unevenness in the original distribution of the LSPs, trouble such as the LSP values ending up leaning heavily to the low order or high order side is liable to occur.

SUMMARY OF THE INVENTION

An object of the present invention is to provide a speech processing apparatus and a mobile communication terminal able to enhance formants more naturally without greatly changing the formant frequencies and also able to improve the intelligibility of speech by more enhancing the feature of the speech, when adjusting the LSP values to improve the intelligibility of speech.

To attain the above object, the speech processing apparatus of the present invention is configured as follows: That is, a speech analyzing unit (100) analyzes an input speech signal to find linear prediction coefficients (LPCs) and converts the LPCs to line spectrum pairs (LSPs) of the speech signal. A speech decoding unit (200) calculates the distance between adjacent orders of the LSPs by an LSP analytical processing unit (3) and calculates LSP adjusting amounts of larger values for LSPs of adjacent orders closer in distance by an LSP adjusting amount calculating unit (4). An LSP adjusting unit (5) adjusts the LSPs based on the LSP adjusting amounts so that the LSPs of adjacent orders closer in distance become further closer. An LSP-LPC converting unit (6) converts the adjusted LSPs to LPCs, then an LPC combining unit (7) uses the LPCs and the sound source parameters to combine and output formant-enhanced speech. By this, a speech processing apparatus enhances speech so that the speech can be intelligibly understood is realized and the formants can be enhanced more naturally to improve the intelligibility of the speech.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

First to fourth aspects of the speech processing apparatus of the present invention will be explained in the following (1) to (4).

(1) A speech processing apparatus for enhancing formants of speech comprising means for calculating a distance between adjacent orders of linear spectrum pairs (LSPs) of a speech signal, means for adjusting the linear spectrum pairs (LSPs) so that distance between LSPs of adjacent orders closer in distance become closer, and means for combining and outputting a speech signal based on the adjusted LSPs.

(2) A speech processing apparatus as set forth in (1), where the means for adjusting the LSPs is provided with means for weighting the LSP adjusting amounts in accordance with the frequencies of the LSPs.

(3) A speech processing apparatus as set forth in (1) or (2), where the means for adjusting the LSPs is provided with means for restricting the orders or the frequency range of the LSPs for adjustment.

(4) A speech processing apparatus as set forth in (1), (2), or (3), further provided with a band-elimination filter for eliminating a specific frequency component of an enhanced speech signal synthesized based on the adjusted LSPs, a band-pass filter for passing the specific frequency component of the speech signal before the enhancement, and means for combining and outputting output signals of the band-elimination filter and band-pass filter.

The mobile communication terminal of the present invention is provided with means for converting a wireless frequency signal to a baseband signal, means for decoding speech parameters from speech encoding parameters of the baseband signal to extract LSPs and sound source parameters, means for calculating distances between adjacent orders of extracted LSPs, means for adjusting the LSPs so that the distance between LSPs of adjacent orders close in distance become closer, and means for synthesizing and outputting a speech signal based on the adjusted LSPs and sound source parameters.

Figure 1:
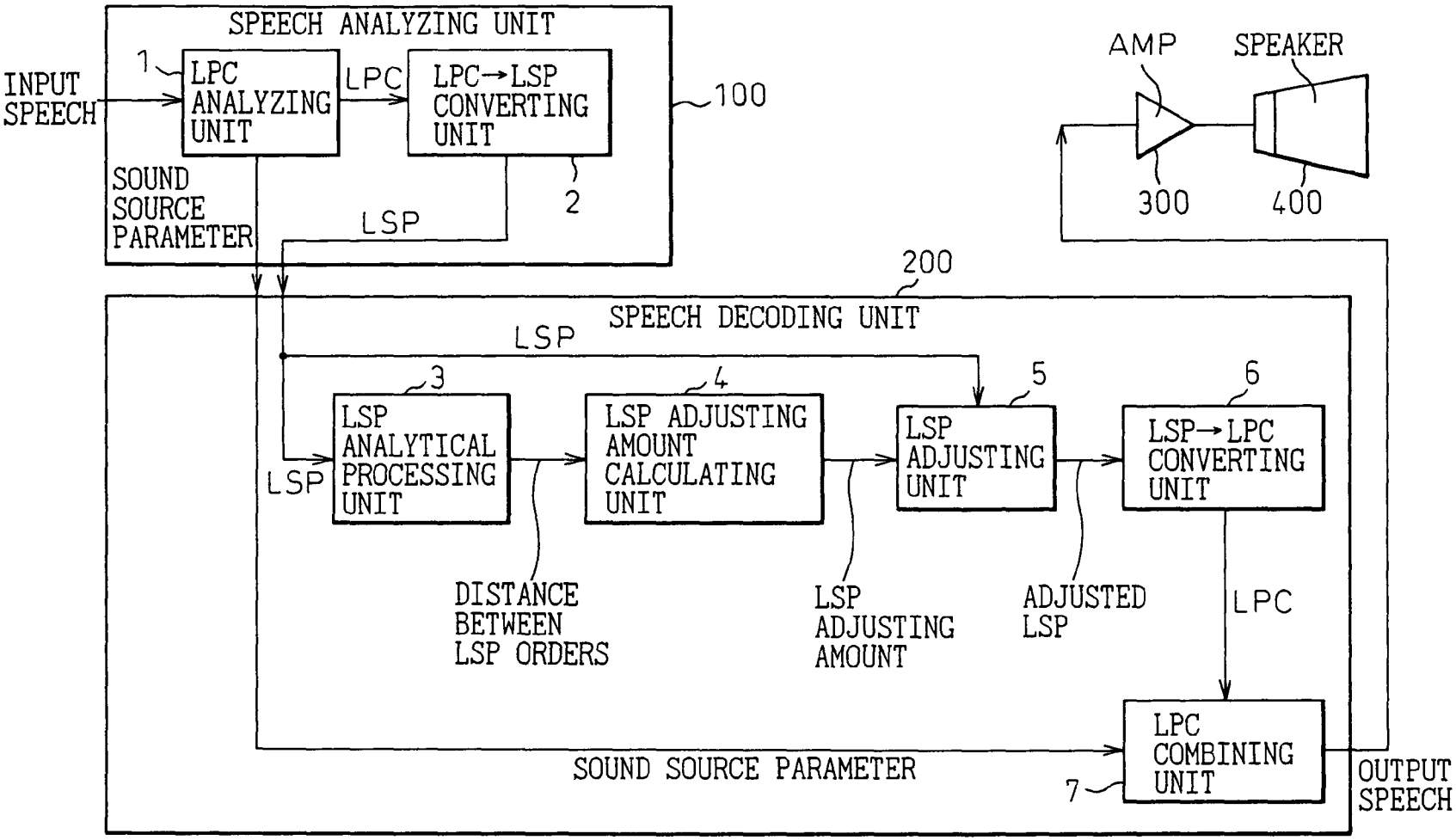
FIG. 1 is a view of the main configuration of a speech processing apparatus according to the present invention.

FIG. 1 shows the main configuration of a speech processing apparatus according to the present invention. In the figure, a speech analyzing unit 100 analyzes LPCs for input speech by an LPC analyzing unit 1 and converts the LPCs obtained by the analysis to values (frequencies) of LSPs by an LPC-LSP converting unit 2.

The input speech may be a speech signal input from a microphone or a speech signal output from a speech decoding apparatus used in a mobile phone or other communication device. For the LPC analysis, it is possible to use the Durbin-Revinson-Itakura method or another analysis algorithm. The sound source parameters analyzed at the LPC analyzing unit 1 and the values of the LSPs converted at the LPC-LSP converting unit 2 are input to a speech decoding unit 200.

The speech decoding unit 200 analyzes the values of the LSPs output from the speech analyzing unit 100, calculates the distances between adjacent orders of LSPs, and outputs the distances between orders of LSPs to an LSP adjusting amount calculating unit 4. The LSP adjusting amount calculating unit 4 calculates the LSP adjusting amounts required for enhancing the formants and outputs the LSP adjusting amounts to an LSP adjusting unit 5.

The LSP adjusting unit 5 adjusts the values of the LSPs output from the speech analyzing unit 100 and outputs the adjusted values of the LSPs to the LSP-LPC converting unit 6. The LSP-LPC converting unit 6 converts the adjusted values of the LSPs to LPCs and outputs the LPCs to the LPC combining unit 7.

The LPC combining unit 7 uses the LCPs converted from the adjusted LSPs and the sound source parameters input from the speech analyzing unit 100 to synthesize speech by linear prediction and generate a formant-enhanced output speech signal. The output speech signal is amplified through an amplifier 300 and output from a speaker 400.

Here, the distances between orders of LSPs calculated at the LSP analytical processing unit 3 will be explained in detail. The LSP analytical processing unit 3 calculates the distances between orders of LSPs by the differences of the values of the LSPs of adjacent orders. Here, if the input value of an LSP of an i-th order is ω[i] and the total number of orders of the LSP is N (for example, N=10), a distance d[i] between orders of LSPs of the i-th order is calculated as follows:

$$d[0]=\omega[0] \tag{2}$$

$$d[i]=\omega[i]-\omega[i-1],\ (1\leqq i\leqq N-1) \tag{3}$$

$$d[N]=\mathrm{MAX}-\omega[N-1] \tag{4}$$

Here, "MAX" is the maximum value which the values ω[i] of LSPs are able to take. d[0] and d[N] are values of the two ends of the LSP orders and require special handling, i.e., the above values are to be set or the value of 0 (zero) is set.

Next, the LSP adjusting amount calculating unit 4 calculates the i-th order LSP adjusting amount Adj[i] based on the distance d[i] calculated by the above equations (2) to (4). The LSP adjusting amount Adj[i] becomes lower the greater the value of the distance d[i] or the greater its power. The calculation equations are given below.

Note that in the following equations, "THRE" is the upper threshold (limit) value of the distance between orders of the LSP values to be adjusted. An LSP value where the distance between orders is greater than this value is not adjusted. "X" is a positive real number suitably selected as a power. "Ratio[i]" is a proximity ratio (0<Ratio[i]<1) expressing how close to make the adjacent two LSPs. Further, "pow (A,B)" expresses the B power of A.

$$\text{When } d[i]>\text{THRE}, \text{Adj}[i]=0 \tag{5}$$

$$\text{When } d[i]\leqq\text{THRE}, \text{Ratio}[i]=\text{pow}((\text{THRE}-d[i])/\text{THRE}, X) \tag{6}$$

However, when Ratio[i]>RTHRE, $$\text{Ratio}[i]=\text{RTHRE} \tag{7}$$

"RTHRE" is the upper threshold value of the Ratio[i] and is set in a range of 0<RTHRE<1.0. For example, RTHRE=0.9 is set.

$$\text{Adj}[i]=(0.5\times d[i])\times\text{Ratio}[i] \tag{8}$$

If the proximity ratio [i] were set to a value of 1 or more, adjustment of the LSP values would cause adjacent LSPs to overlap at the same values (when Ratio[i]=1) or adjacent LSPs to end up crossing each other (when Ratio[i]>1), so the Ratio[i] is made a value less than 1. In the above example, from equation (7), the upper limit of Ratio[i] is made 0.9.

A specific example of calculation of the LSP adjusting amounts Adj[i] by equations (2) to (8) will be explained with reference to FIG. 2.

Figure 2:
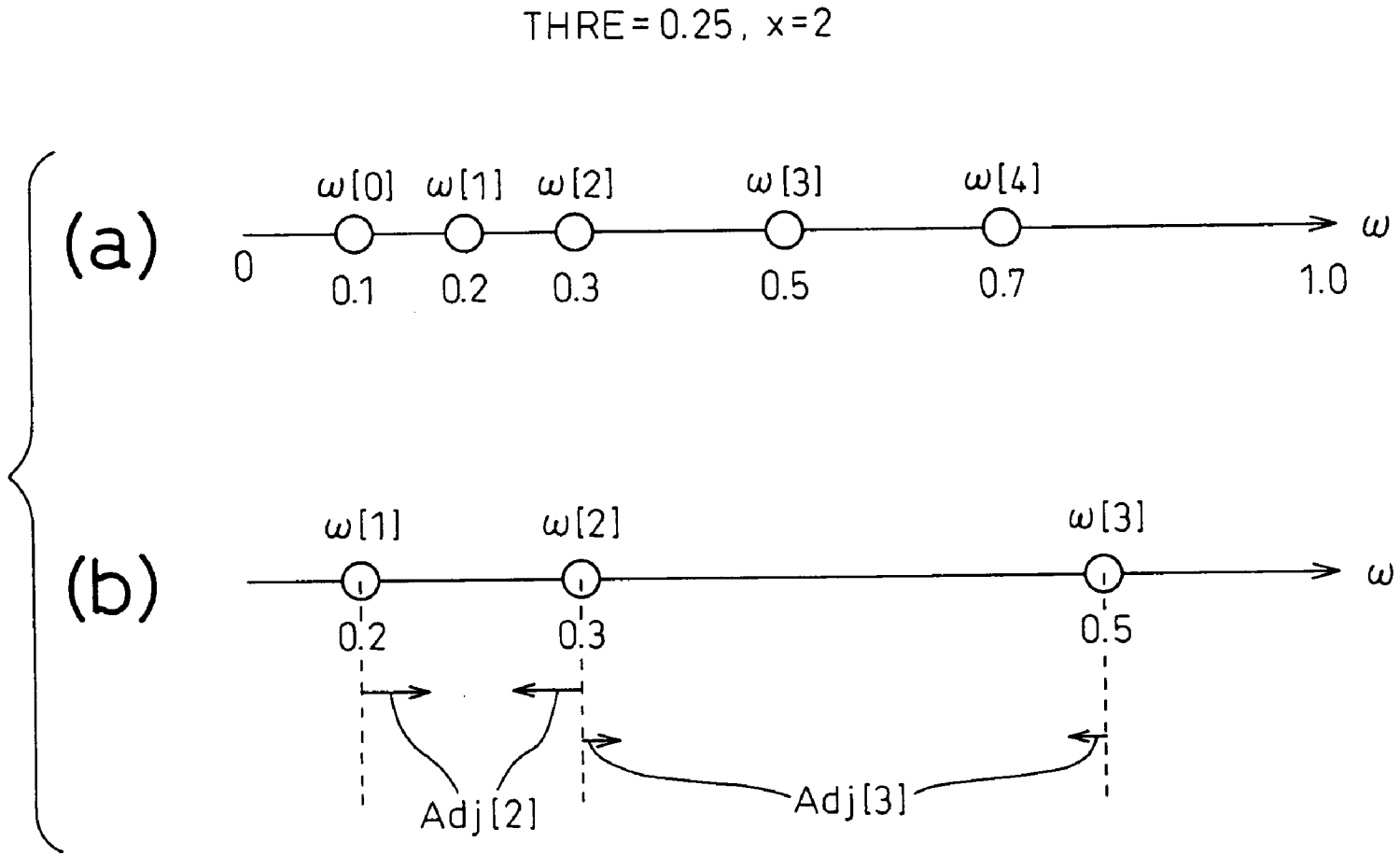
FIG. 2 is a view of the adjustment action of LSPs according to the present invention.

(a) of FIG. 2 shows examples of the numerical values of the 0-th order to the fourth order LSP values ω[0] to ω[4]. Here, the LSP values ω[0] to ω[4] are assumed to be normalized to a range from 0 to 1.0.

As shown in (a) of FIG. 2, the values of the LSPs are ω[0]=0.1, ω[1]=0.2, ω[2]=0.3, ω[3]=0.5, and ω[4]=0.7. Further, the upper threshold value THRE of the distances between orders is made 0.25, the power X is made 2, and the maximum value MAX able to be taken by values of LSPs is made 1.0.

If calculating the distances d[i] between orders of LSPs for respective orders in accordance with equations (2) to (4), the results are:

$$d[0]=0.1,$$

$$d[1]=0.1,$$

$$d[2]=0.1,$$

$$d[3]=0.2,$$

$$d[4]=0.2,$$

$$d[5]=0.3.$$

Next, by equations (5) to (8), $$\text{Ratio}[0]=((0.25-0.1)/0.25)^2=0.36,$$

$$\text{Adj}[0]=(0.5\times0.1)\times0.36=0.018,$$

$$\text{Ratio}[1]=((0.25-0.1)/0.25)^2=0.36,$$

$$\text{Adj}[1]=(0.5\times0.1)\times0.36=0.018,$$

$$\text{Ratio}[2]=((0.25-0.1)/0.25)^2=0.36,$$

$$\text{Adj}[0]=(0.5\times0.1)\times0.36=0.018,$$

$$\text{Ratio}[3]=((0.25-0.2)/0.25)^2=0.04,$$

$$\text{Adj}[3]=(0.5\times0.1)\times0.04=0.002,$$

$$\text{Ratio}[4]=((0.25-0.2)/0.25)^2=0.04,$$

$$\text{Adj}[4]=(0.5\times0.1)\times0.04=0.002,$$

$$\text{Adj}[5]=0.0 \text{ (since } d[5]>\text{THRE)}$$

In this way, it is learned that the closer the values of adjacent LSPs, the greater the value of the LSP adjusting amount Adj. When adjusting LSP values based on LSP adjusting amounts Adj obtained in this way, for example the LSP adjusting amount Adj[2] calculated from the LSP value ω[1] and LSP value ω[2] is used to adjust both of the LSP value ω[1] and LSP value ω[2].

That is, it is used for both the adjusting amount for moving the LSP value ω[1] from the LSP value ω[1] of the current point of time in the direction toward the LSP value ω[2] and the adjusting amount for moving the LSP value ω[2] from the LSP value ω[2] of the current point of time in the direction toward the LSP value ω[1]. Due to this adjustment action, the values of the LSPs close in distance become closer. This adjustment action is similarly applied to all LSP values.

The above adjustment action will be explained next referring to (b) of FIG. 2. The LSP adjusting amount Adj[2] is used for both the LSP value ω[1] and the LSP value ω[2] and has an adjustment action moving the LSP value ω[1] in the positive direction (right direction in the figure) and the LSP value ω[2] in the negative direction (left direction in the figure).

Further, the LSP adjusting amount Adj[3] is used for both the LSP value ω[2] and the LSP value ω[3] and has an adjustment action moving the LSP value ω[2] in the positive direction (right direction in the figure) and the LSP value ω[3] in the negative direction (left direction in the figure). Due to this, an adjustment action of {−Adj[2]+Adj[3]} works for the LSP value ω[2].

Expressing the adjusting amounts Adj_all[i] due to the adjustment action in both directions by an equation, the result is:

$$\text{Adj_all}[i]=-\text{Adj}[i]+\text{Adj}[i+1](0\leqq i\leqq N-1) \tag{9}$$

By adding the bidirectional LSP adjusting amounts Adj_all[i] to the LSP values ω[i] of the input speech signal, the LSP values ω[i] are adjusted. The adjusted LSP values ω[i] are expressed by the following equation (10):

$$\omega'[i]=\omega[i]+\text{Adj_all}[i] \tag{10}$$

Figure 3:
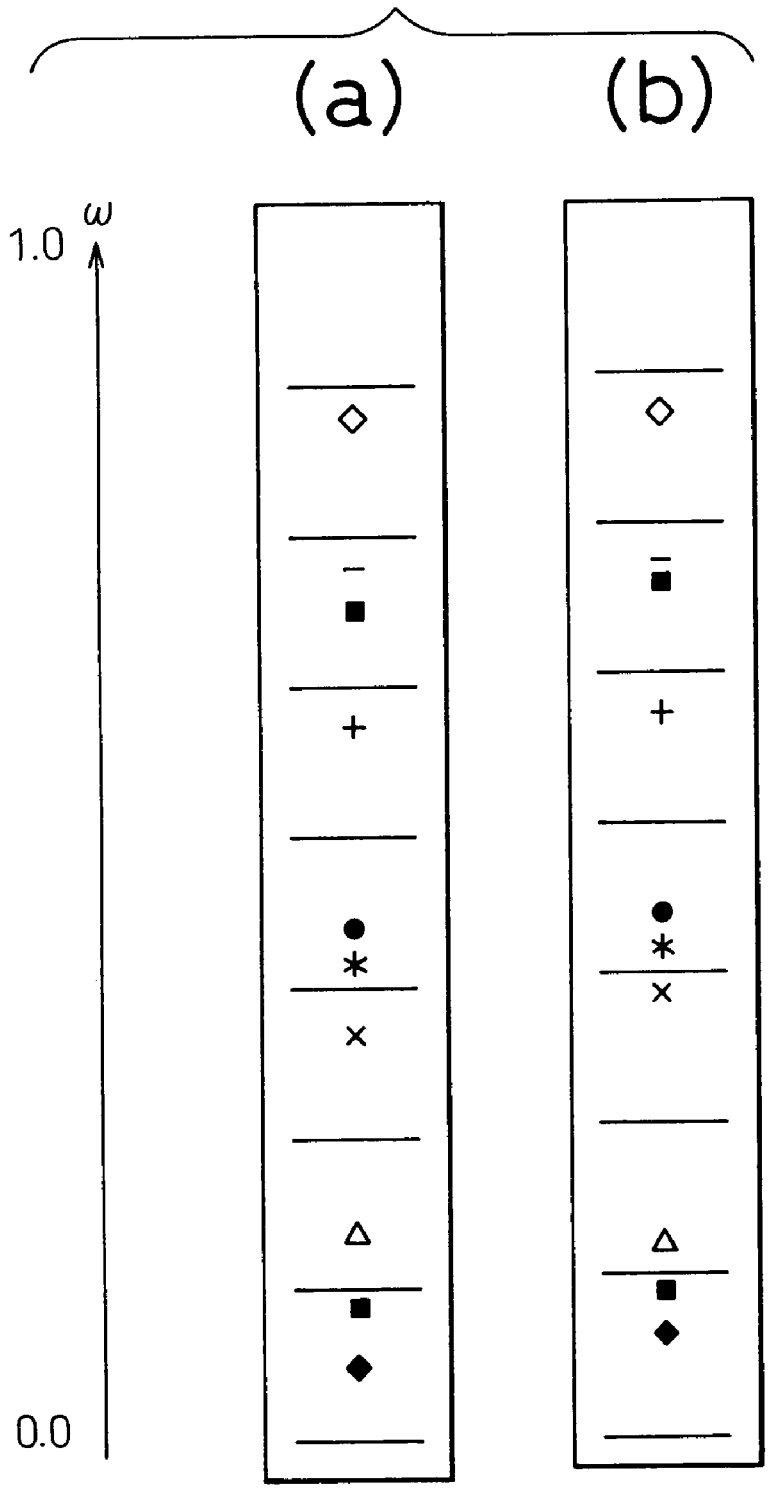
FIG. 3 is a view of a specific example of adjustment of LSPs according to the present invention.

A specific example of the LSP values ω[i] adjusted in this way is shown in FIG. 3. (a) of FIG. 3 plots the LSP values ω[i] before adjustment, while (b) of FIG. 3 plots the LSP values ω[i] after adjustment. For example, it will be understood that the LSP values ω[i] close to each other originally such as the bottom three points (Δ, ■, ♦) become closer due to the adjustment of the LSPs.

By adjusting the LSPs such that the LSPs of adjacent orders having distances less than a certain threshold THRE become closer, the formants of the speech are enhanced. A specific example of the formants enhanced by adjustment of the LSPs is shown in FIG. 4.

Figure 4:
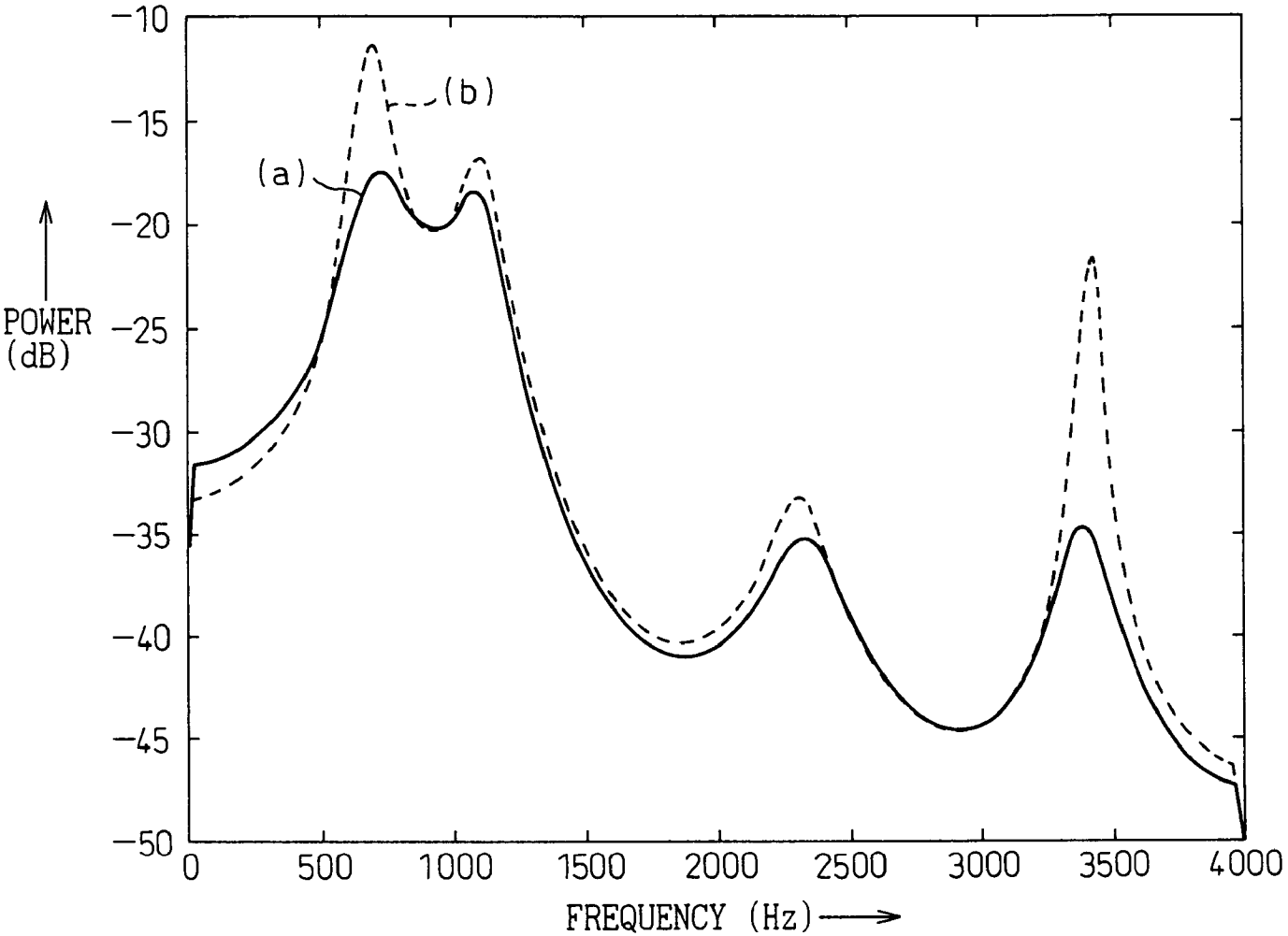
FIG. 4 is a view of a specific example of formants enhanced by the present invention.

FIG. 4 shows a speech signal frequency spectral envelop. In the figure, the solid line "a" shows the spectral envelop before LSP adjustment, while the broken line "b" shows the spectral envelop after LSP adjustment. From the figure, it will be understood that the formants are enhanced by the LSP adjustment.

Figure 5:
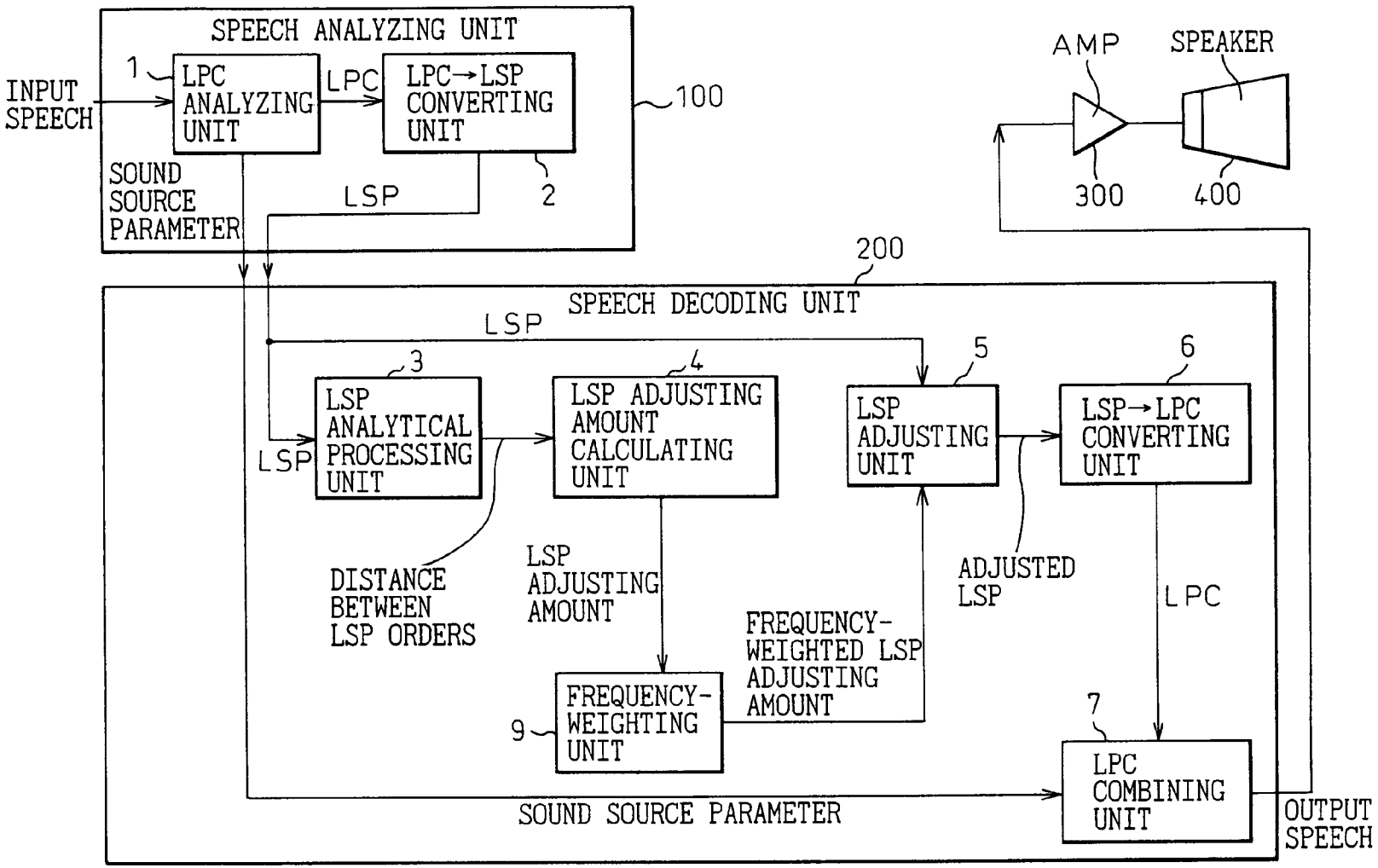
FIG. 5 is a view of a speech processing apparatus of the present invention weighting by frequency.

Next, FIG. 5 shows a speech processing apparatus of the present invention weighting in accordance with frequency. The speech processing apparatus of this embodiment features the addition of a frequency-weighting unit 9 for weighting by frequency the LSP adjusting amounts Adj[i] obtained from the speech processing apparatus shown in FIG. 1. For the rest of the configuration, components the same as those shown in FIG. 1 are assigned the same reference numerals as in FIG. 1 and overlapping explanations are omitted. The frequency-weighting unit 9 weights by frequency the LSP adjusting amounts Adj_[i] obtained from the LSP adjusting amount calculating unit 4.

In general, the effect of formant enhancement appears stronger at the lower frequencies. Over-enhancement sometimes conversely causes degradation of the sound quality. This occurs because the formants of the low frequencies are originally strong. Therefore, by suppressing the LSP adjusting amounts Adj[i] for the low frequency LSPs in the LSP adjusting amounts Adj[i] obtained from the LSP adjusting amount calculating unit 4, extreme formant enhancement is avoided.

As a specific example of derivation of the LSP adjusting amounts Adj[i] weighted by frequency, it is possible to derive the amounts by processing by the following equation (11) or equation (12).

$$\mathrm{Adj}'[i]=(\omega[i]/\mathrm{MAX})\times\mathrm{Adj}[i] \tag{11}$$

$$\mathrm{Adj}'[i]=\mathrm{pow}(\omega[i]/\mathrm{MAX},X)\times\mathrm{Adj}[i] \tag{12}$$

In the above equation (11) or (12), "MAX" is the maximum value which the LSP values ω[i] can take, while "Adj[i]" is an LSP adjusting amount before weighting. Further, "X" is a positive real number suitably selected as a power, and "pow(A,B)" expresses the B power of A.

The LSP adjusting amounts Adj'[i] output from the frequency-weighting unit 9 of FIG. 5 are output to the above-mentioned LSP adjusting unit 5. The LSP adjusting unit 5 uses the LSP adjusting amounts Adj'[i] to adjust the values of the LSPs input from the speech analyzing unit 100 and outputs the adjusted values of the LSPs to the LSP-LPC converting unit 6. The rest of the operation is similar to the operation of the speech processing apparatus shown in FIG. 1.

Figure 6:
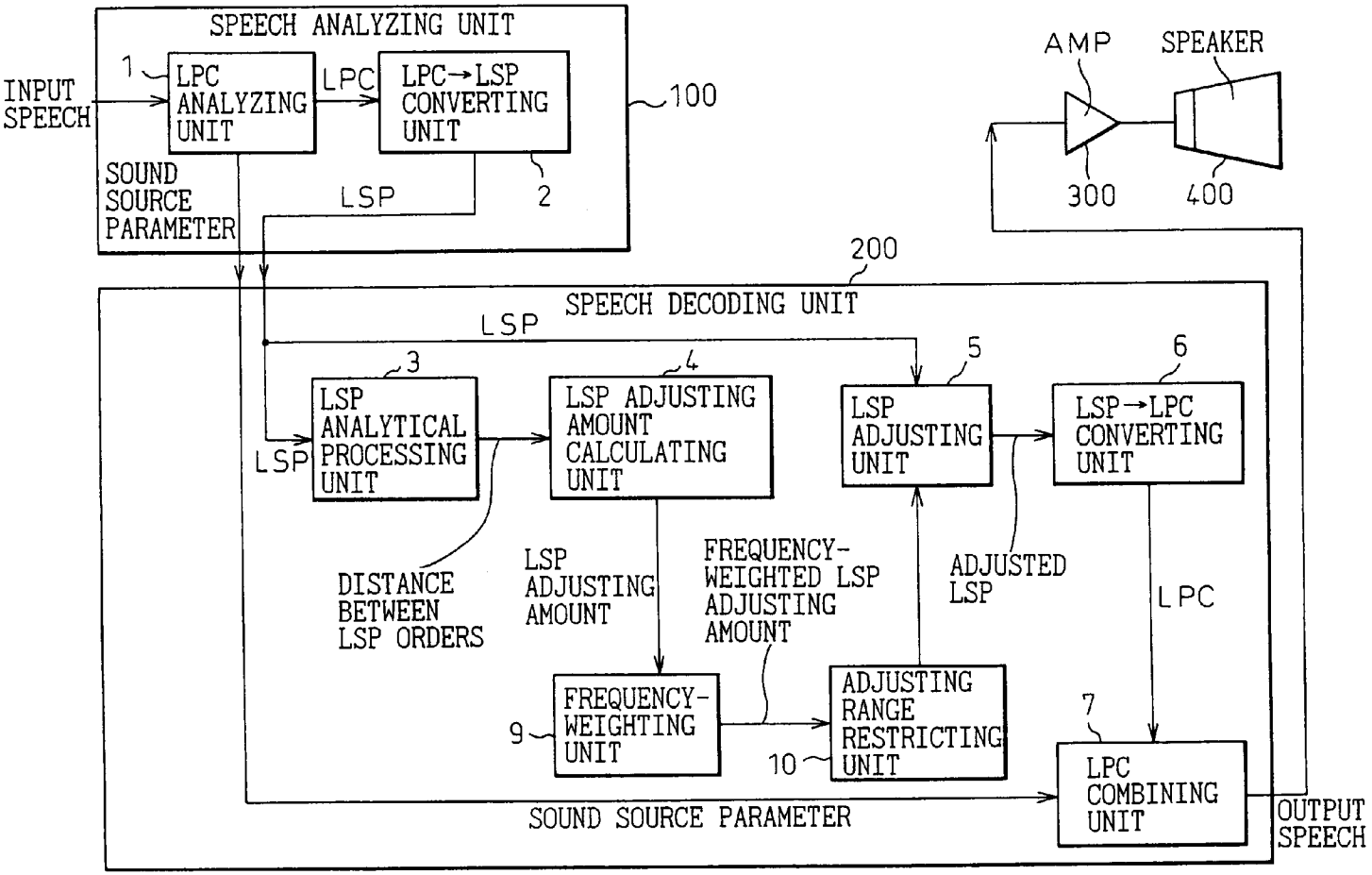
FIG. 6 is a view of a speech processing apparatus of the present invention restricting the range of adjustment.

Next, FIG. 6 shows a speech processing apparatus of the present invention restricting the range of adjustment. The speech processing apparatus of this embodiment is comprised of the speech processing apparatus of FIG. 1 or FIG. 5 plus an adjusting range restricting unit 10. The adjusting range restricting unit 10 performs processing for selectively restricting the frequency range (range of orders of LSPs) for adjustment of the LSP values.

If enhancing the formants, sometimes the characteristics of the low frequency components of the speech greatly change and the quality of speech ends up deteriorating. To avoid such deterioration in the quality of speech, it is possible not to adjust the LSP values in a frequency range where adjustment is expected to cause extreme changes in the speech so as to prevent the above deterioration of quality and improve intelligibility.

As specific means for restricting the range of adjustment of the LSP values, the adjusting range restricting unit 10 is provided with means for setting the orders of the range of restriction of adjustment for LSP adjusting amounts Adj[i] of the orders (0th to Mth) in the range where adjustment is expected to cause extreme changes in the speech. The adjusting range restricting unit 10 outputs LSP adjusting amounts Adj"[i] having adjusting amounts of 0 (zero) as the LSP adjusting amounts Adj[i] of the orders (0th to Mth) of the set range of restriction as shown in the following equation (13):

$$\mathrm{Adj}''[i]=0.0\ (0\leqq i\leqq M) \tag{13}$$

where, $(0\leqq M\leqq N)$

Alternatively, the adjusting range restricting unit 10 can be configured to output the LSP adjusting amounts Adj"[i] as 0.0 (zero) for the i-th orders specified from the outside. In this case, the adjusting range restricting unit 10 outputs the LSP adjusting amounts Adj"[i] to the LSP adjusting unit 5, then the LSP adjusting unit 5 uses the LSP adjusting amounts Adj"[i] to adjust the values of the LSPs input from the speech analyzing unit 100 and outputs the adjusted values of the LSPs to the LSP-LPC converting unit 6. The rest of the operation is similar to the operation of the speech processing apparatus shown in FIG. 1.

Figure 7:
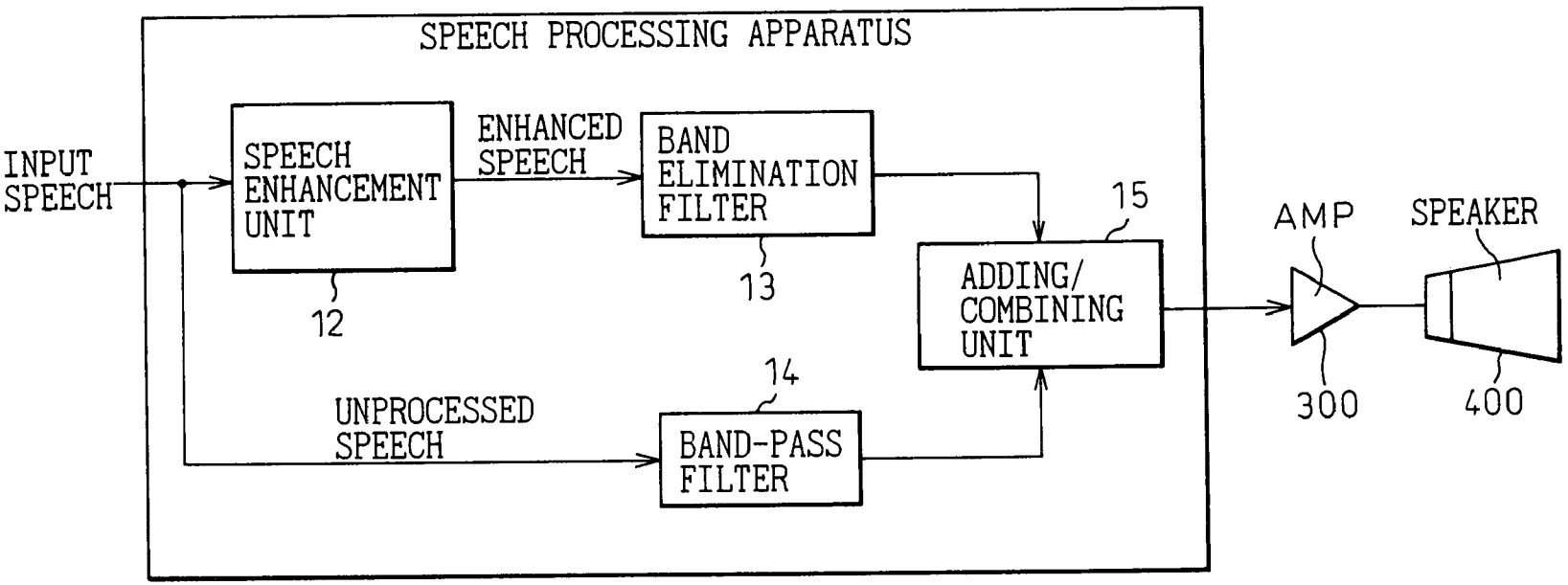
FIG. 7 is a view of a speech processing apparatus of the present invention adjusting the frequency range of speech enhancement.

Next, FIG. 7 shows a speech processing apparatus of the present invention adjusting the frequency range of the speech enhancement. In general, when enhancing speech by formant enhancement etc., sometimes the speech is overly enhanced and sounds strange to the listener. In such a case, it is possible to reduce the strangeness by replacing a frequency band likely to cause the sound strangeness with unprocessed speech, i.e., not speech enhanced.

As shown in FIG. 7, the enhanced speech signal output from a speech enhancement unit 12 enhancing speech by formant enhancement or another technique is passed through a band-elimination filter 13 removing a predetermined frequency band and then input to an adding/combining unit 15. On the other hand, unprocessed speech comprised of the input speech not enhanced is passed through a band-pass filter 14 passing that predetermined frequency band and input to the adding/combining unit 15.

That is, the frequency band likely to cause sound strangeness due to enhancement is removed by passing through the band-elimination filter 13, while unprocessed speech not enhanced is passed through the band-pass filter 14 and the thus passed band is used in place of the frequency band of the speech removed at the band-elimination filter 13. The outputs of the band-elimination filter 13 and the band-pass filter 14 are combined at the adding/combining unit 15. As a result, enhanced speech free from any feeling of strangeness is output from the adding/combining unit 15.

As the above band-elimination filter 13 and the band-pass filter 14, it is preferable to use filters which are mutually complementary filters to give substantially flat frequency characteristics when combining their output signals.

Figure 8:
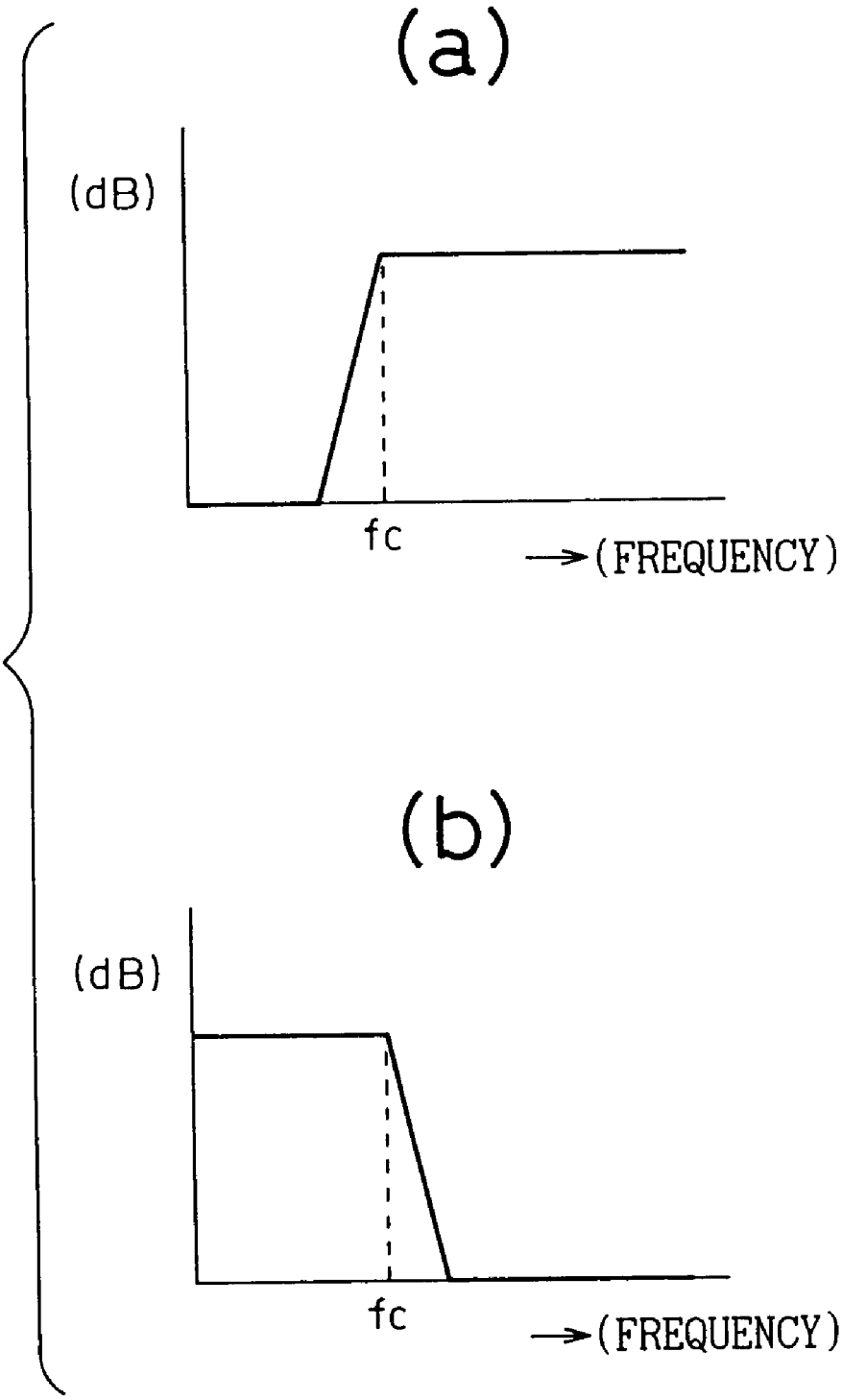
FIG. 8 is a view of the characteristics of a filter adjusting the frequency range of speech enhancement.

As such filters, for example, a high-pass filter having a characteristic as shown in (a) of FIG. 8 and a low-pass filter having a characteristic as shown in (b) of FIG. 8 are used so that the cutoff frequencies fc become the same in the two filters as illustrated. Due to this, it is possible to form the above mutually complementary filters.

These speech processing apparatuses of the present invention can be realized by partially modifying the processing units or functional circuits in conventional speech decoding apparatuses. Alternatively, they can be realized by adding processing units or functional circuits for LSP adjustment according to the present invention to conventional speech decoding apparatuses or speech reproducing apparatuses.

Figure 9:
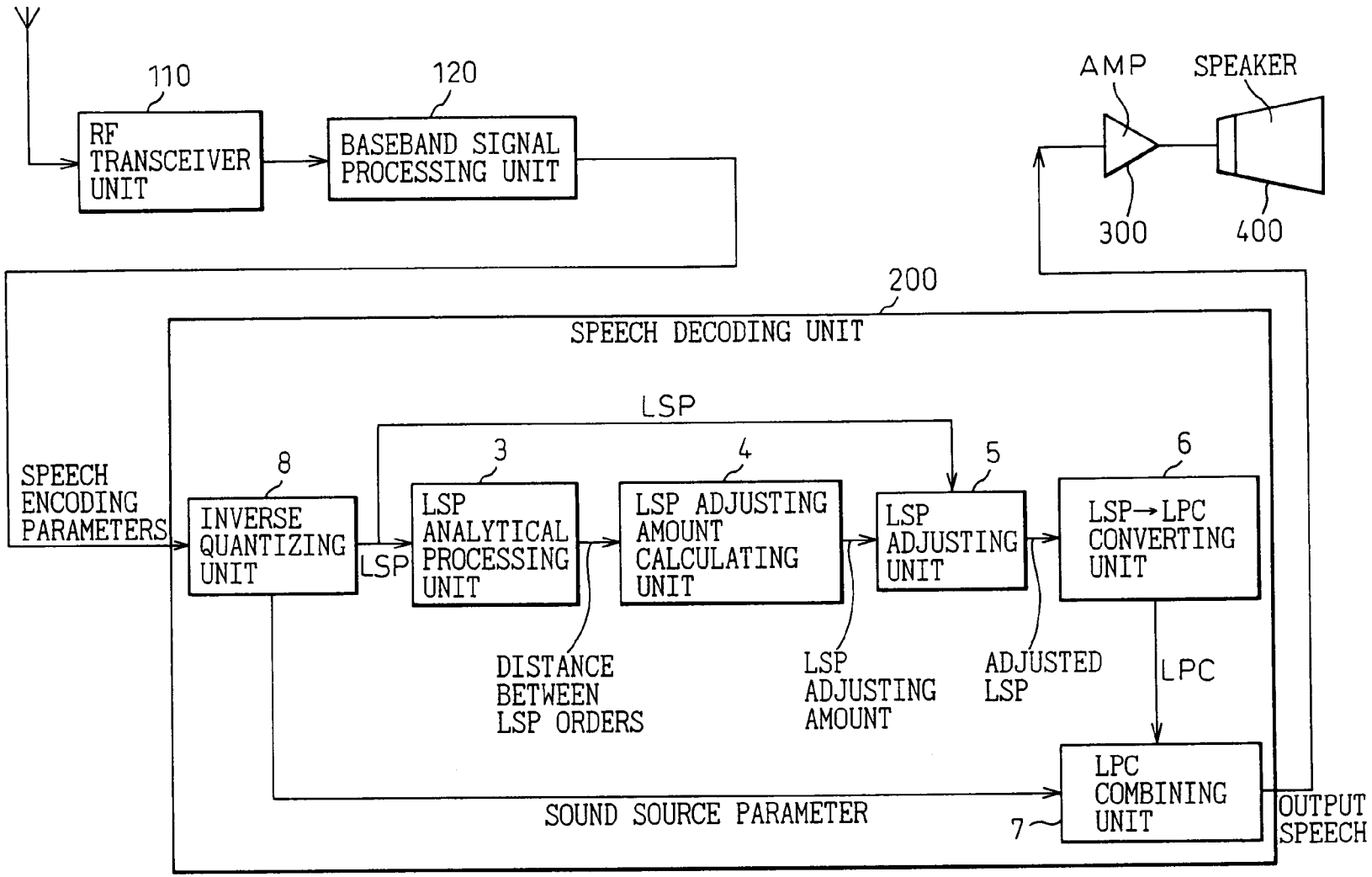
FIG. 9 is a view of an example of the configuration of a mobile communication terminal employing the speech processing function of the present invention.

FIG. 9 shows an example of a configuration applying the above speech processing function to a mobile phone or other mobile communication terminal. The figure shows the configuration of a receiving unit of a mobile communication terminal. The mobile communication terminal receives a wireless frequency signal input from an antenna at an RF transceiver unit 110 and demodulates the wireless frequency signal by a baseband signal processing unit 120 to convert it to a baseband signal.

The speech encoding parameters of the baseband signal are input to a speech decoding unit 200. The speech decoding unit 200 decodes the speech parameters from the speech encoding parameters by an inverse quantizing unit 8 to extract the LSPs and sound source parameters. The extracted LSPs are input to the LSP analytical processing unit 3, while the sound source parameters are input to the LPC combining unit 7.

The LSP analytical processing unit 3, in the same way as the speech processing apparatus shown in FIG. 1, calculates the distances between orders of LSPs and outputs the distances between orders of LSPs to the LSP adjusting amount calculating unit 4. The LSP adjusting amount calculating unit 4 calculates the LSP adjusting amounts based on the distance between orders of LSPs and outputs the LSP adjusting amounts to the LSP adjusting unit 5.

The LSP adjusting unit 5 adds the LSP adjusting amounts to the original LSP values to adjust the LSP values and outputs the adjusted LSP values to the LSP-LPC converting unit 6. The LSP-LPC converting unit 6 converts the adjusted values of the LSPs to the LPCs and outputs the LPCs to the LPC combining unit 7.

The LPC combining unit 7 uses the LPCs obtained by conversion from the adjusted LSPs and the sound source parameters input from the inverse quantizing unit 8 to synthesize speech by linear prediction and generates a formant-enhanced output speech signal. The output speech signal is passed through the amplifier 300 for amplification and output from the speaker 400.

The configuration shown in FIG. 9 can be realized by partially modifying the processing of the conventional speech decoder used in a mobile phone or other mobile communication terminal and adding the LSP analytical processing unit 3, LSP adjusting amount calculating unit 4, and LSP adjusting unit 5. Here, as the speech decoder, it is possible to use a system using LSP parameters for high performance compression and decompression of a speech signal by digital signal processing, for example, an adaptive multi rate speech codec (AMR-speech CODEC) decoder standardized by the 3rd Generation Partnership Project (3GPP).

Note that while not illustrated, it is also possible to suitably add to the speech decoding apparatus of the mobile communication terminal the above-explained function of LSP adjustment by weighting by frequency, the function of restricting the range of adjustment of LSPs, or the function of adjusting the frequency range of speech enhancement.

Summarizing the advantageous effects of the invention, as explained above, by adjusting values of the LSPs such that LSPs of adjacent orders closer in distance become closer, it is possible to naturally enhance formants without causing the LSPs to shift as a whole and without a change in the formant frequencies and therefore possible to reduce deterioration of the quality of speech. Further, it is possible to reproduce more natural and intelligible speech even in a noisy environment.

Further, when adjusting LSPs, by weighting by frequency or by restricting the range of adjustment so as not to enhance the formants of certain frequency components, it is possible to prevent extreme changes in the speech due to speech enhancement and therefore reproduce more natural speech.

Further, by passing the enhanced speech through a band-elimination filter to remove a frequency component with extreme changes and replacing the band of the speech signal removed by the band-elimination filter with an unenhanced input speech signal obtained by passing the input speech signal before enhancement through a band-pass filter, only the formants of a band required for improvement of intelligibility are enhanced, so it is possible to enhance speech while keeping down to a minimum the feeling of strangeness of the speech.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2002-250362, filed on Aug. 29, 2002, the disclosure of which is expressly incorporated herein by reference in its entirety.

What is claimed is:

1. A speech processing apparatus for enhancing formant components of speech comprising:

a calculating function unit which calculates a distance between adjacent orders of linear spectrum pairs of a speech signal, an adjusting function unit which adjusts the linear spectrum pairs so that a distance between linear spectrum pairs of adjacent orders closer in distance become closer, and an outputting function unit which combines and outputs a speech signal based on the adjusted linear spectrum pairs.

2. A speech processing apparatus as set forth in claim 1, where the adjusting function unit is provided with a weighting function unit which weights adjusting amounts of the linear spectrum pairs in accordance with the frequencies of the linear spectrum pairs.

3. A speech processing apparatus as set forth in claim 1, where the adjusting function unit is provided with a restricting function unit which restricts the orders or the frequency range of the linear spectrum pairs for adjustment.

4. A speech processing apparatus as set forth in claim 1, further comprising:

a band-elimination filter which removes a specific frequency component of an enhanced speech signal synthesized based on the adjusted linear spectrum pairs, a band-pass filter which passes said specific frequency component of the speech signal before enhancement, and a combining and outputting function unit which combines and outputs the output signals of the band-elimination filter and band-pass filter.

5. A mobile communication terminal comprising:

a converting function unit which converts a wireless frequency signal to a baseband signal, an extracting function unit which decodes speech parameters from speech encoding parameters of the baseband signal to extract linear spectrum pairs and sound source parameters, a calculating function unit which calculates a distance between adjacent orders of extracted linear spectral parameters, an adjusting function unit which adjusts the linear spectrum pairs so that the distance between the linear spectrum pairs of adjacent orders closer in distance become closer, and a combining and outputting function unit which combines and outputs a speech signal based on the adjusted linear spectrum pairs and sound source parameters.

6. A mobile communication terminal as set forth in claim 5, where the adjusting function unit is provided with a weighting function unit which weights adjusting amounts of linear spectrum pairs in accordance with the frequencies of the linear spectrum pairs.

7. A mobile communication terminal as set forth in claim 5, where the adjusting function unit is provided with a restricting function unit which restricts the orders or frequency range of the linear spectrum pairs for adjustment.

8. A mobile communication terminal as set forth in claim 5, further comprising:

a band-elimination filter which removes a specific frequency component of an enhanced speech signal synthesized based on the adjusted linear spectrum pairs, a band-pass filter which passes said specific frequency component of the speech signal before enhancement, and a combining and outputting function unit which combines and outputs output signals of the band-elimination filter and band-pass filter.

* * * * *